US011725323B2

(12) United States Patent
Palmeira et al.

(10) Patent No.: US 11,725,323 B2
(45) Date of Patent: Aug. 15, 2023

(54) WASH ARTICLE ENTRAPMENT DETECTION FOR LAUNDRY WASHING MACHINES

(71) Applicant: Electrolux Home Products, Inc., Charlotte, NC (US)

(72) Inventors: Eduardo Palmeira, Charlotte, NC (US); Brian Hobbs, Charlotte, NC (US); Murilo Costa, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 106 days.

(21) Appl. No.: 17/237,557

(22) Filed: Apr. 22, 2021

(65) Prior Publication Data

US 2022/0341080 A1 Oct. 27, 2022

(51) Int. Cl.
*D06F 33/47* (2020.01)
*D06F 34/18* (2020.01)
(Continued)

(52) U.S. Cl.
CPC ..... *D06F 33/47* (2020.02); *D06F 34/18* (2020.02); *D06F 37/18* (2013.01); *D06F 23/02* (2013.01); *D06F 33/32* (2020.02); *D06F 2103/24* (2020.02); *D06F 2103/38* (2020.02); *D06F 2103/46* (2020.02); *D06F 2105/48* (2020.02); *D06F 2105/62* (2020.02)

(58) Field of Classification Search
CPC ..... D06F 33/32; D06F 33/47; D06F 34/14; D06F 34/18; D06F 34/20; D06F 37/18; D06F 2103/24; D06F 2103/38; D06F 2103/46; D06F 2105/48; D06F 2105/62
See application file for complete search history.

(56) References Cited

U.S. PATENT DOCUMENTS 4,765,161 A 8/1988 Williamson
5,293,760 A 3/1994 Tani et al.
(Continued)

FOREIGN PATENT DOCUMENTS

EP 1500738 A1 1/2005
EP 2607537 A1 6/2013
(Continued)

OTHER PUBLICATIONS

International Search Report and Written Opinion for International Application No. PCT/US2022/023254, dated Jul. 22, 2022, 14 pages.
(Continued)

*Primary Examiner* — Joseph L. Perrin
(74) *Attorney, Agent, or Firm* — RatnerPrestia

(57) ABSTRACT

A method for detecting entrapment of an article between a laundry machine door and bellows, comprising: identifying a maximum startup motor torque value of the drum motor while accelerating the drum from a stop to a target rotation speed; identifying a maximum operating motor torque value while rotating the drum at the target rotation speed; comparing a difference between the maximum startup motor torque value and the maximum operating motor torque value to a predetermined torque difference value; and terminating operation if the difference exceeds the predetermined torque difference value. A laundry washing machine configured to perform the method is also provided.

20 Claims, 4 Drawing Sheets

(51) Int. Cl.

| | |
|---|---|
| ***D06F 33/32*** | (2020.01) |
| ***D06F 37/18*** | (2006.01) |
| *D06F 105/48* | (2020.01) |
| *D06F 23/02* | (2006.01) |
| *D06F 103/38* | (2020.01) |
| *D06F 103/24* | (2020.01) |
| *D06F 103/46* | (2020.01) |
| *D06F 105/62* | (2020.01) |

(56) References Cited

U.S. PATENT DOCUMENTS

| | | | |
|---|---|---|---|
| 5,339,474 | A | 8/1994 | Kim et al. |
| 5,713,221 | A | 2/1998 | Myers et al. |
| 6,029,300 | A | 2/2000 | Kawaguchi et al. |
| 6,047,428 | A | 4/2000 | Min |
| 6,241,782 | B1 | 6/2001 | Haar |
| 6,282,965 | B1 | 9/2001 | French et al. |
| 6,381,791 | B1 | 5/2002 | French et al. |
| 6,393,918 | B2 | 5/2002 | French et al. |
| 6,401,284 | B1 | 6/2002 | Jeon et al. |
| 6,418,758 | B1 | 7/2002 | Ikeda et al. |
| 6,530,100 | B2 | 3/2003 | Conrath |
| 6,578,225 | B2 | 6/2003 | Jonsson |
| 6,594,841 | B2 | 7/2003 | Broker et al. |
| 6,615,619 | B2 | 9/2003 | Kakuda et al. |
| 6,640,372 | B2 | 11/2003 | Ciancimino et al. |
| 6,715,175 | B2 | 4/2004 | Ciancimino et al. |
| 7,401,480 | B2 | 7/2008 | Poehler |
| 7,571,506 | B2 | 8/2009 | Poehler |
| 7,739,765 | B2 | 6/2010 | Ashrafzadeh et al. |
| 7,950,255 | B2 | 5/2011 | Ashrafzadeh et al. |
| 8,122,549 | B2 | 2/2012 | Park et al. |
| 8,631,527 | B2 | 1/2014 | Ashrafzadeh et al. |
| 8,875,332 | B2 | 11/2014 | Janke et al. |
| 9,080,277 | B2 | 7/2015 | Erickson et al. |
| 9,157,177 | B2 | 10/2015 | Buendia et al. |
| 9,200,400 | B2 | 12/2015 | Janke et al. |
| 9,765,463 | B2 | 9/2017 | Ashrafzadeh et al. |
| 9,822,476 | B2 | 11/2017 | Janke et al. |
| 9,890,490 | B2 | 2/2018 | Janke et al. |
| 9,957,653 | B2 | 5/2018 | Ashrafzadeh et al. |
| 10,273,621 | B2 | 4/2019 | Bodin et al. |
| 10,669,663 | B2 | 6/2020 | Bodin et al. |
| 2003/0145392 | A1 | 8/2003 | Hird |
| 2005/0102766 | A1 | 5/2005 | Haar et al. |
| 2008/0109967 | A1 | 5/2008 | Ashrafzadeh et al. |
| 2008/0120789 | A1 | 5/2008 | Ashrafzadeh et al. |

FOREIGN PATENT DOCUMENTS

| | | | |
|---|---|---|---|
| JP | 11333187 | A | 7/1999 |
| WO | 2018007146 | A1 | 1/2018 |
| WO | 2018228804 | A1 | 12/2018 |
| WO | 2020060269 | A1 | 3/2020 |

OTHER PUBLICATIONS

International Search Report and Written Opinion for International Application No. PCT/US2022/023242, dated Jul. 29, 2022, 13 pages.

WASH ARTICLE ENTRAPMENT DETECTION FOR LAUNDRY WASHING MACHINES

TECHNICAL FIELD

The present invention relates to the field of laundry washing machine operating condition detection, and particularly to detecting the presence of an article trapped between the drum door and bellows seal.

BACKGROUND

Laundry washing machines ("washers") are in common use. Such machines may be configured as a dedicated washer that is configured solely to wash or clean the laundry, or as a combination washer/dryer that also has active laundry drying features (e.g., a heat pump, gas heater, or electric heater in combination with a forced air system). Other configurations also may be possible (e.g., a washer with multiple separate wash compartments, etc.). As used herein, the terms "washer" and "washing machine" are intended to include all such variations.

Washers include a tub to hold wash liquid, and a drum that is configured to rotate within the tub. In many cases, the tub and drum are oriented in use with the drum configured to rotate about a horizontal axis (i.e., angled less than 45° relative to the 90° vertical gravitational direction, and typically much closer to 0° degrees). In such washers, access to the drum may be provided via a door located along the rotation axis, and a bellows seal (or simply "bellows") may be provided to seal the door to the tub, to prevent wash liquid from escaping around the door during operation.

A problem with washers having a door and bellows arrangement is that wash articles, such as clothing, linens, extraneous articles (e.g., balls, lighters, keys and so on that might be introduced with clothing) and the like, can become trapped between the door and the bellows. Such entrapment can occur at the time the door is closed, or during operation if the wash articles are pressed between the door and bellows. If the user does not detect and correct the entrapment, rotation of the drum can create forces on the article that can damage the bellows and the article. Such damage typically occurs late in the washing cycle, when the drum is rotated at high speed to extract water in preparation for subsequent active drying. This damage can include tearing the article, removing portions of the bellows, partially removing portions of the bellows from engagement with the door or tub, and even complete separation of the bellows from the tub and door. Such damage can lead to undesirable washing results, temporary or permanent water leaks, and repair or replacement costs.

A conventional washing cycle begins with relatively slow drum movement (tumbling or back-and-forth motions) during the initial water loading and washing phases, and concludes with a high-speed spinning phase to extract water from the laundry. Some washers are configured to perform initial low-speed phases to evaluate the condition of the laundry articles. For example, the drum may be rotated to perform inertia pre-estimation, load distribution evaluation and correction, and for other purposes. It has been found to be difficult to detect entrapped articles during the initial load evaluation stages, and attempts to detect entrapped articles typically are performed during a high-speed dynamic imbalance measurement phase that is performed prior to or during a high-speed spin drying phase. At this point, entrapped articles experience forces that can cause damage (damage prior to this phase is possible, but less likely). Thus, damage may already occur by the time the entrapment is detected.

The inventors have determined that it would be desirable to detect article entrapment at the beginning of the wash cycle and prior to beginning a high-speed spinning phase such as an imbalance measurement phase or a spin drying phase.

This description of the background is provided to assist with an understanding of the following explanations of exemplary embodiments, and is not an admission that any or all of this background information is necessarily prior art.

SUMMARY

In a first aspect, there is provided a method for detecting entrapment of a wash article within a laundry washing machine comprising a tub configured to hold a quantity of wash liquid, a drum rotatably mounted within the tub and configured to hold a quantity of wash articles, a door movable between an open position and a closed position, a bellows seal configured to seal the door to the tub when the door is in the closed position, and a drum motor configured to rotate the drum. The method comprises: receiving an instruction to begin a laundry washing cycle; operating the drum motor to accelerate the drum from a stopped state to a target rotation speed; while accelerating the drum from the stopped state to the target rotation speed, monitoring a startup motor torque value of the drum motor and identifying a maximum startup motor torque value; and, upon accelerating the drum to the target rotation speed, initiating an entrapment determination process. The entrapment determination process includes: initiating an entrapment determination process timer; operating the drum motor to rotate the drum at the target rotation speed; monitoring an operating motor torque value of the drum motor; identifying a maximum operating motor torque value; determining a difference in value between the maximum startup motor torque value and the maximum operating motor torque value; comparing the difference in value between the maximum startup motor torque value and the maximum operating motor torque value to a predetermined torque difference value; upon determining that the difference in value between the maximum startup motor torque value and the maximum operating motor torque value is less than the predetermined torque difference value, terminating operation of the entrapment determination process and terminating operation of the laundry washing cycle; and upon determining that the difference in value between the maximum startup motor torque value and the maximum operating motor torque value is greater than the predetermined torque difference value, and upon the entrapment determination process timer reaching a predetermined time value, terminating operation of the entrapment determination process and continuing operation of the laundry washing cycle.

In some examples, the target rotation speed comprises about 55 to about 65 rotations per minute.

In some examples, the target rotation speed comprises about 60 rotations per minute.

In some examples, the target rotation speed is less than a satellization speed.

In some examples, the entrapment determination process timer has a duration of 10 seconds or less.

In some examples, terminating operation of the laundry washing cycle comprises terminating operation of the drum motor and activating an alarm at a user interface.

In some examples, continuing operation of the laundry washing cycle comprises operating the drum motor, one or more valves, and one or more pumps to perform a sequence of laundry cleaning phases.

In some examples, comparing the difference in value between the maximum startup motor torque value and the maximum operating motor torque value to the predetermined torque difference value is performed at one or more intervals prior to the entrapment determination process timer reaching the predetermined time value.

In some examples, comparing the difference in value between the maximum startup motor torque value and the maximum operating motor torque value to the predetermined torque difference value is performed upon the entrapment determination process timer reaching the predetermined time value.

In some examples, the a drum is rotatably mounted to rotate about a horizontal axis.

In another exemplary aspect, there is provided a laundry washing machine comprising: a tub configured to hold a quantity of wash liquid; a drum rotatably mounted within the tub and configured to hold a quantity of wash articles; a door movable between an open position and a closed position; a bellows seal configured to seal the door to the tub when the door is in the closed position; a drum motor configured to rotate the drum; and a control unit having a processor and a memory storing, in a non-transient manner, instructions that, when executed by the processor, cause the control unit to perform one or more of the methods described in the summary above.

BRIEF DESCRIPTION OF THE DRAWINGS

Embodiments of inventions will now be described, strictly by way of example, with reference to the accompanying drawings, in which.

DESCRIPTION OF EXEMPLARY EMBODIMENTS

Figure 1:
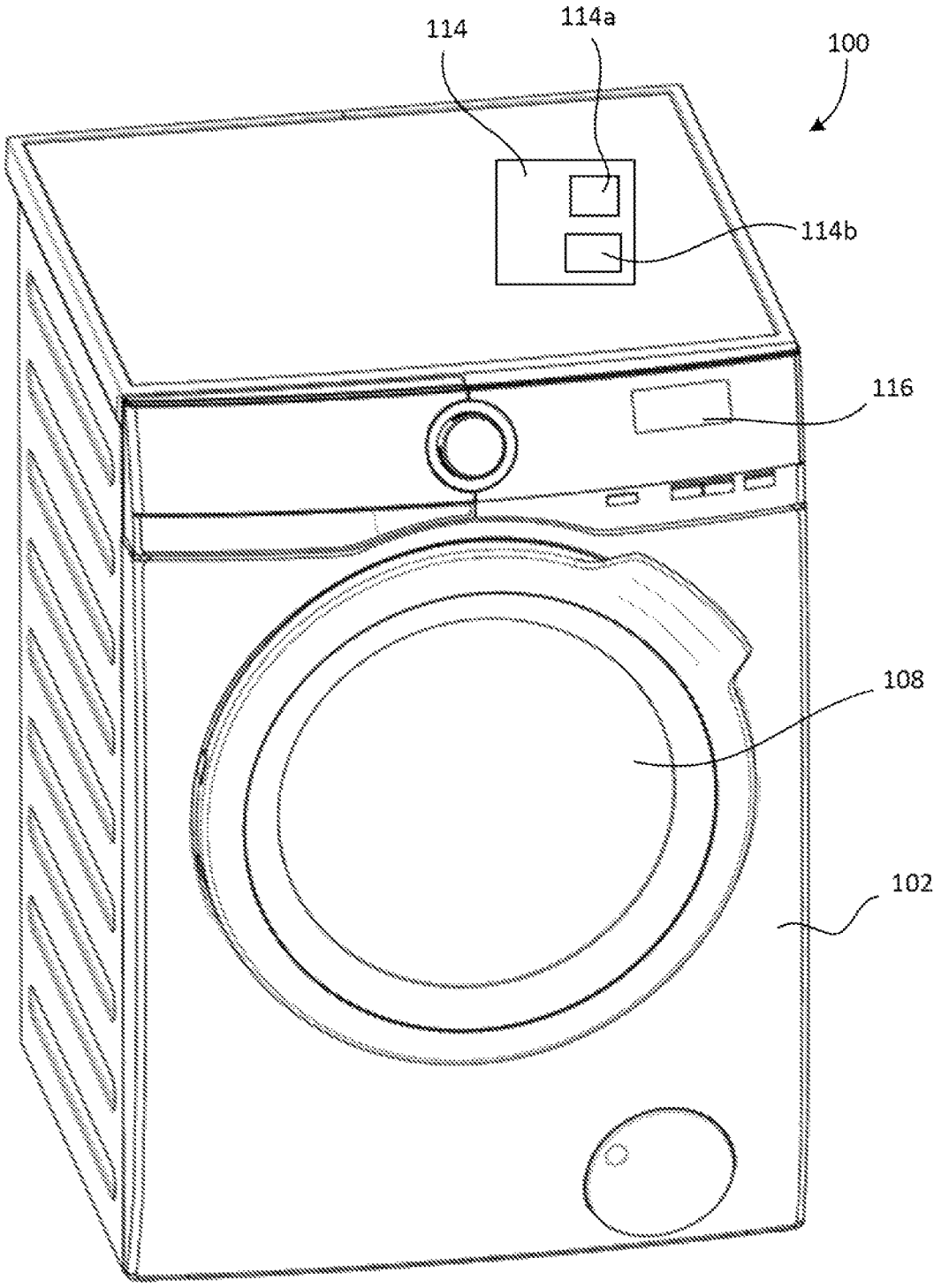
FIG. 1 illustrates an exemplary laundry washing machine according to embodiment herein.
Figure 2:
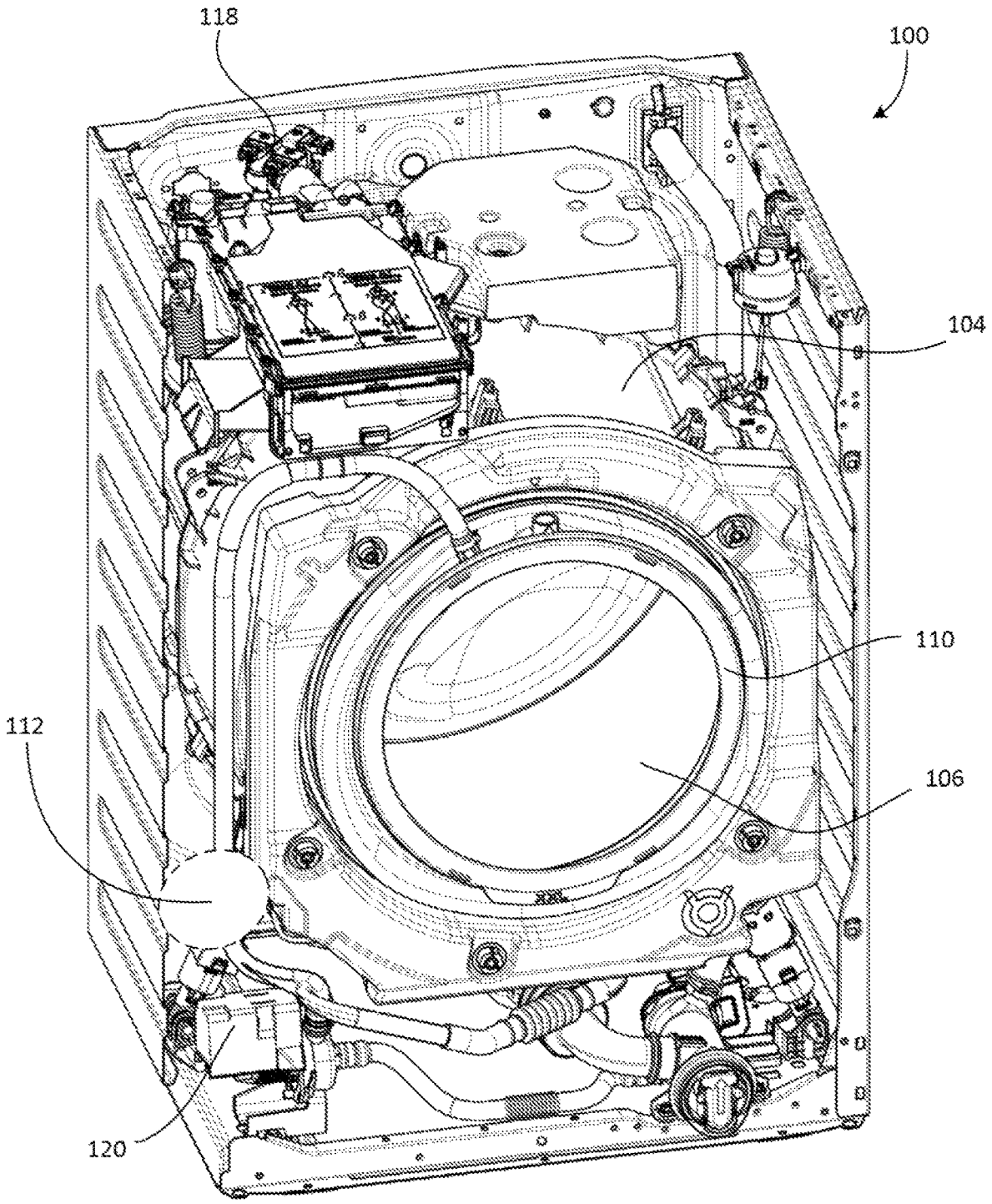
FIG. 2 illustrates the washing machine of FIG. 1 with the external casing removed.

FIGS. 1 and 2 illustrate an exemplary laundry washing machine 100 that may be configured to perform processes to detect entrapment of a wash article between the door and the bellows seal. The washing machine generally comprises a housing 102, a tub 104, a drum 106, a door 108, a bellows seal 110 ("bellows"), and a drum motor 112. The housing 102 is configured to stand on a horizontal surface and provide a structure to hold the remaining parts of the washing machine 100.

The tub 104 is suspended inside the housing 102 by a shock-absorbing system, and generally comprises water-impermeable walls with inlets and/or outlets leading to other parts of the fluid management system (pumps, drains, etc.) to thereby form a container for holding wash liquid (water, detergent, bleach, fabric softener, etc.). The drum 106 is mounted inside the tub 104 by a bearing assembly (not shown) that allows the drum 106 to rotate about a rotation axis. The drum 106 has a water-permeable wall to allow fluid transfer between the interior of the drum 106 and the surrounding tub 104. The drum 106 and tub 104 have aligned open ends, which are adjacent to an opening through the housing 102, to provide an access port for inserting and removing laundry articles into the drum 106. In this case, the drum 106 and tub 104 comprise generally cylindrical structures, and the drum 106 rotates about a generally horizontal axis (i.e., less than 45° relative to a horizontal surface upon which the machine 100 rests in use, and more preferably less than about 20° relative to such surface), but this is not strictly required.

The door 108 is attached to the housing 102 by a hinge or the like, to allow the door 108 to move (e.g., about a vertical pivot axis) between a closed position (FIG. 1) and an open position (not shown). The bellows 110 is connected to the open end of the tub 104, and to the opening through the housing 102, to provide a water-tight seal between the tub 104 and the housing 102. In the closed position, the door 108 presses against the bellows 110 to form a water-tight seal between the bellows 110 and the door 104. Thus, the door 108 closes and seals the access port to the drum 106. A latch (not shown) may be provided to hold the door 108 in the closed position.

A drum motor 112 (shown schematically) is mounted within the housing 102, and connected to the drum 106 via a drive shaft, gears, belts and pulleys, or the like, to thereby be configured to apply a drive torque to rotate the drum 106. The drum motor 112 may comprise any suitable electric motor, as known in the art.

The washing machine 100 includes a control unit 114 (shown schematically) comprising a processor **114*a* and a memory 114*b* that stores instructions in a non-volatile manner. The washing machine 100 also may include one or more sensors (e.g., water level, etc.). The washing machine 100 also has a user interface 116 having input devices (buttons, dials, switches, etc.) and output devices (lights, audio speakers, etc.). The user interface 116** may be extended wirelessly to a smart phone application or other remote control device via a wireless communications device (e.g., near field communication transceiver, infrared transceiver, wireless protocol transceiver, etc.). Details of processors, memories, user interfaces, and wireless communications with remote devices and applications are all known in the art, and need not be described in detail herein.

In use, the control unit 114 is operated to receive a user selection of an operation cycle from the user interface 116, and control the washing machine 100 to perform the selected operation cycle. Operation cycle instructions are stored in the memory **114*b*, and the processor 114*a* accesses the memory 114*b* to read the instructions, in a well-known manner. Each operation cycle may include, for example, a water filling phase in which valves 118 are operated to fill the tub 104 with wash liquid, an agitation phase in which the drum motor 112 is operated to spin or reciprocate the drum 106, a draining phase in which a pump 120 is operated to remove free liquid from the laundry articles, a rinsing phase, in which the valves 118 are operated to fill the tub 104 with fresh water, a second draining phase to remove free liquid form the laundry articles, and a high-speed spin stage in which the drum motor 112 is operated to spin the drum 106 at high speed to extract bound water from the laundry articles. The processor 114*a* carries out the instructions, using sensor feedback as may be indicated in the instructions, to operate the drum motor 112, as well as various other operative parts (e.g., valves 118, heaters, pumps 120**, etc.).

The foregoing description provides just one example of a laundry washing machine 100 that may be used to implement methods described herein. Details of the structure and operation of such as laundry washing machine 100, as well as variations on such structures and operations, are well-known in the art, and need not be described in greater detail herein.

It has been determined that a washing machine 100, such as the one described above or otherwise, can be operated to detect a condition indicating the presence of an article trapped between the bellows 110 and the door 108 during an initial start-up phase of a washing cycle, using feedback from the drum motor 112. Examples of such entrapment detection algorithms are described in relation to the illustrations provided as FIGS. 3 and 4.

The entrapment detection algorithm 300 ("the algorithm") begins at step 302 by receiving an instruction to begin a laundry washing cycle. The laundry washing cycle may be selected by the user at the user interface 116, and when selection is complete, the user may press a "start" button or the like. The start instruction also may be generated by a timer, remote control, or via other means, as known in the art.

Next, at step 304, the control unit 114 operates the drum motor 112 to accelerate the drum from a stopped state to a target rotation speed St. The target rotation speed St may be any steady-state rotation speed. It has been determined that a speed or 60 rotations per minute ("rpm") provides beneficial results, as described below, but it is expected that speeds on the order of 55 rpm to 65 rpm will yield similar results. It is also expected that other speeds, outside this range, can also be successfully used. It will be understood that the designation of a target rotation speed St may comprise a designation of a specific rotation speed (e.g., 60 rpm), or a designation of a predetermined range such as 55 to 65 rpm (i.e., 60 rpm±5 rpm). Any particular specific speed will be understood to include operating variations as may be caused by or experienced using typical control algorithms.

The target rotation speed St preferably is less than the satellization speed, which is the speed at which the wash articles are pressed by centrifugal force against the wall of the drum 106 throughout the entire rotation of the drum. The satellization speed varies depending on drum size, and potentially other factors such as the angle of the drum rotation axis, but generally can be readily determined by conventional calculations as a speed sufficient to generate a centrifugal force that equals or exceeds the gravitational force at the top of the drum 106. Selecting the target rotation speed St to be below the satellization speed is preferred because it is expected that operation at the satellization speed may provide a relatively inaccurate comparison of measured operating torques, as described below, between the acceleration phase and the steady-state operation phase. Nevertheless, if such comparison is found to be useful, embodiments may use a target rotation speed St comprising a satellization speed.

While the drum is being accelerated to the target rotation speed St, the control unit 114 monitors the drive torque of the drum motor 112, as shown as step 306. The drive torque value may be monitored at any suitable frequency, such as continuously (i.e., at a frequency as fast at the control unit 114 can operate according to its internal clock cycle), or intermittently (i.e., at some frequency less than a maximum possible frequency). The drive torque value may be monitored or calculated using any suitable technique, which may vary depending on the type of motor, the drive control system, and other factors. For example, a drive torque value be estimated via motor current, using known motor models and equations. As another example, a torque transducer may be incorporated into the motor drive system. The drum motor torque 112 may comprise a an actual torque measurement or estimation (e.g., a value in pounds-feet units), or it may be represented by a measured value that represents motor torque (e.g., a current value in amps or voltage value in volts). It is not strictly necessary to determine a unit value of the drive torque; rather, a unitless value may be used. Thus, for purposes of implementing embodiments herein, the "torque value" refers to any unit or unitless measurement or representation of drive torque, as may be indicated by a relevant variable (e.g., variations in measured current, variations in measured voltage representative of variations in measured current, etc.). Other alternatives and variations will be apparent to persons of ordinary skill in the art in view of the present disclosure, and such controls and torque determination methods are well-known in the art and need not be described in greater detail herein.

Figure 3:
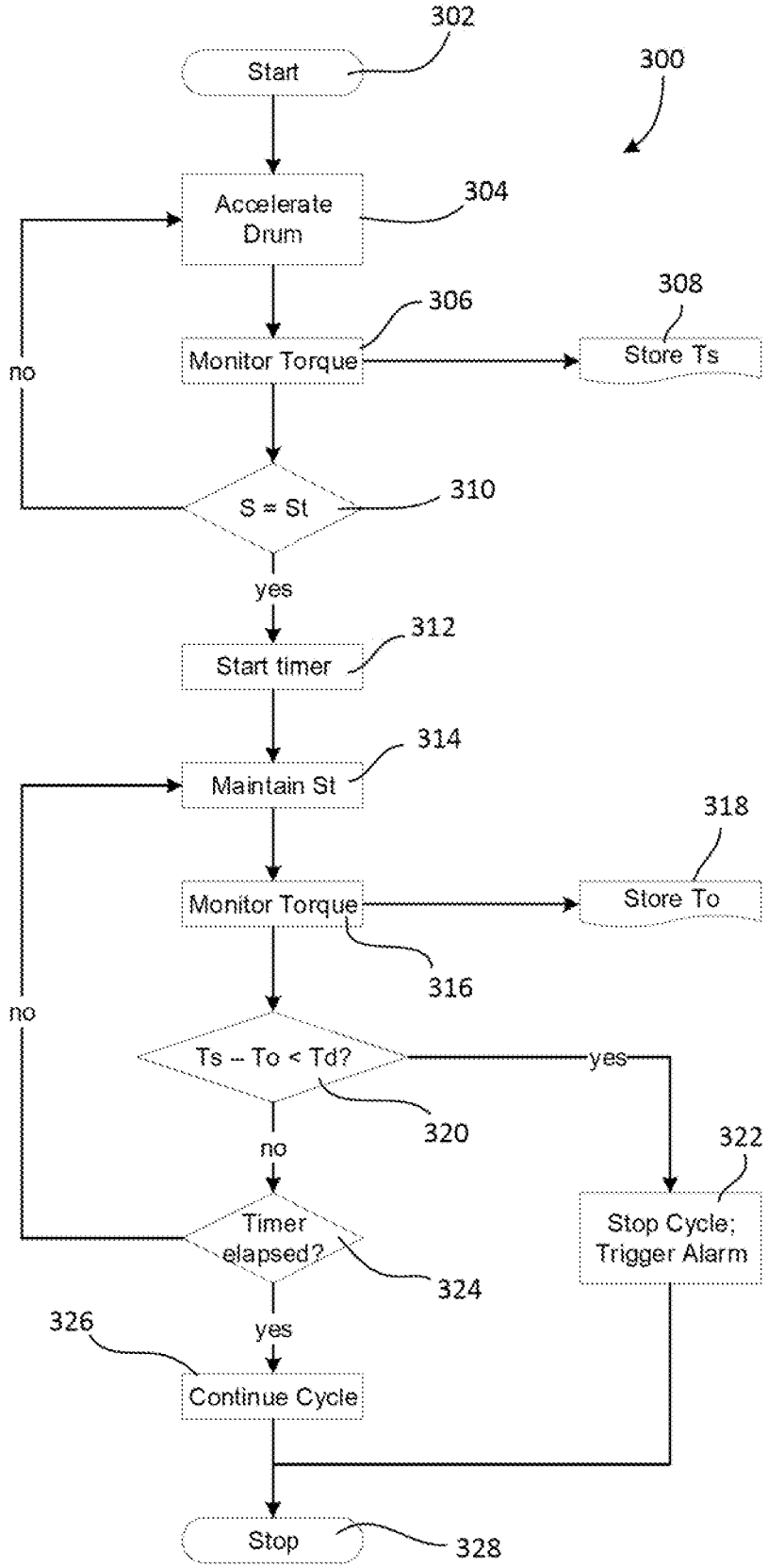
FIG. 3 illustrates an exemplary control algorithm.
Figure 4:
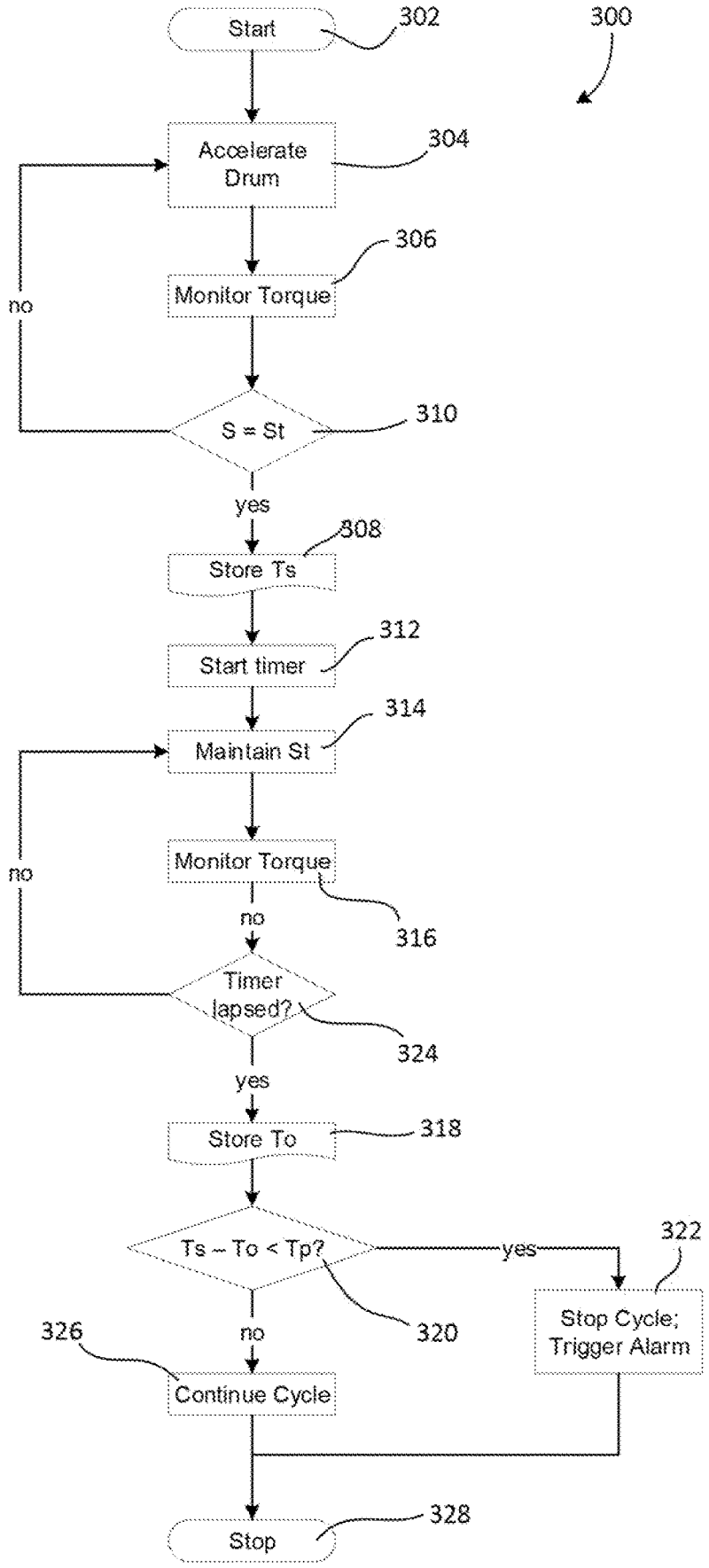
FIG. 4 illustrates another exemplary control algorithm.

During, or at the end of, the acceleration phase (i.e., until the target rotation speed St is reached), the control unit 114 stores the maximum monitored value of the drum motor drive torque as a variable in the memory 114*b*, as shown in step 308. For example, the control unit 114 may update a maximum startup motor torque value Ts variable each time it detects a new motor drive torque that exceeds a prior stored maximum startup motor torque value Ts, which is shown in FIG. 3. As another example, the control unit 114 may record a series of drum motor drive torque values during the acceleration phase, and then select the torque value with the highest magnitude as the maximum startup motor torque value Ts once the drum 106 has achieved the target rotation speed St, which is shown in FIG. 4.

At step 310, the control unit 114 monitors the drum rotation speed S to determine when it reaches the target rotation speed St. For example, the control unit 114 may monitor rotation speed by evaluating the periodicity of variations in the drum motor 112 drive torque or other operating variables (voltage, current, etc.) or by using a sensor such as an optical tachometer or hall-effect sensor, as known in the art.

Upon reaching the target rotation speed St, the control unit 114 enters an entrapment determination process. The entrapment determination process begins in step 312 by initiating a timer to measure the duration of the entrapment determination process. The use of the timer is discussed in more detail below. The timer may comprise any suitable clock-based or event-based measurement, such as a measure of seconds, clock cycles, drum rotations, and so on. For example, the timer may be a 30 second timer (which could be considered a 30 rotation timer if the drum is operated at 60 rpm), or longer, but shorter durations are more preferred, as explained below.

At step 314, the control unit 114 operates the drum motor 112 to maintain the drum 106 at the predetermined rotation speed St. This may be accomplished, for example, by entering a feedback control loop to maintain the drum rotation speed S at or near the target rotation speed St until further instructions are given to modify the rotation speed. If the drum rotation speed S varies from the target rotation speed St by a predetermined amount, the control unit 114 operates the drive motor 112 to accelerate or slow the drum 106, as needed to return to the target rotation speed St. Similarly, if the target rotation speed St includes a range, the control unit 114 may apply controls to the drum motor 112 when the actual rotation speed S reaches the end values of the range, to thereby maintain (or attempt to maintain) the rotation speed S within the target range. Standard proportional integral (PI) controls, or similar controls, may be used to control the drum rotation speed S, as known in the art. If the control unit 114 is unable to maintain the drum rotation speed S at the target rotation speed S, or within a range of acceptable speeds, the control unit 114 may terminate operation and display an error signal to the user at the user interface 116, or take other steps.

While maintaining the target rotation speed St in a generally steady-state operating condition (or at least attempting to do so), the control unit 114 monitors the operating drive torque of the drum motor 112, as shown as step 316. As explained before in relation to step 306, the drive torque value may be monitored at any suitable frequency, and the drive torque value may be monitored or calculated using any suitable technique, and using any unit or unitless value.

During monitoring, the control unit 114 stores the maximum value of the drum motor operating drive torque as a variable in the memory 114*b*, as shown in step 318. For example, the control unit 114 may update a maximum operating motor torque value To variable each time it detects a new motor drive torque that exceeds a prior stored maximum operating motor torque value To, which is illustrated in FIG. 3. As another example, the control unit 114 may record a series of drum motor drive torque values during the entrapment determination process (i.e., until the timer lapses), and then select the torque value with the highest magnitude as the maximum operating motor torque value To. This process is illustrated in FIG. 4.

At step 320, the control unit 114 determines a difference in value between the maximum startup motor torque value Ts and the maximum operating motor torque value To, and compares the difference in value with a predetermined torque difference value Td. The outcome of this determination is used to determine whether there is an article entrapped between the door 108 and the bellows 110.

More particularly, the drum motor torque experiences a sudden increase ("spike") in drive torque that is significantly greater than the magnitude of torque required to rotate the drum 106 at steady state at, for example, 60 rpm. The magnitudes of the initial torque spike during acceleration and the maximum drive torque during steady-state operation are affected by factors such as the mass and distribution of the laundry load within the drum 106, changes in operating state of the motor, and the need to overcome the static inertia of the laundry load starting from an unmoving state. It has been found, however, that during normal operation (i.e., no entrapment) the difference in magnitude between the torque spike during startup acceleration, and the operating torque during steady-state rotation, is generally greater than a determinable value, regardless of the size or composition of the laundry load. For example, in a typical laundry washing machine sold as a 600 Series Front-Load washing machine by Electrolux Major Appliances of Charlotte, N.C., it has been found that, the difference between the maximum startup torque Ts and the maximum operating torque To is typically greater than about 0.23 Newton-meters (Nm).

In contrast, it has been found that the presence of an article entrapped between the door 108 and the bellows 110 has a relatively little effect on the maximum startup torque Ts and a relatively large effect on the maximum steady-state operating torque To. Specifically, it has been found that an entrapped article can create a drag force that increases startup torque Ts to a relatively small degree, and increases operating torque To a relatively large degree. Without being bound to any theory of operation, it is believed that this differential increase in torque could, at least in some cases, be the result of the entrapped article becoming entangled with and pulling on other articles as the drum 106 achieves a higher rotation speed.

Regardless of the mechanism causing the phenomenon, it has been discovered that the difference between the maximum startup torque value Ts and the maximum operating torque value To (i.e., the maximum startup torque value Ts minus the maximum operating torque value To) will typically have a value that is less for a load having an entrapped article, than a corresponding value for a load that does not have an entrapped article. For example, it has been found that during entrapment conditions in the laundry washing machine referenced above, the maximum operating torque value To can be very close to, and even exceed the maximum startup torque value Ts. Thus, subtracting the maximum operating torque value To from the maximum startup torque value Ts can yield values as low as −0.45 Nm or lower.

In application, the difference between the maximum startup torque value Ts and the maximum operating torque value To (i.e., Ts−To) can be used to predict whether an entrapment condition exists, by comparing this value to a predetermined torque difference value Td representing a typical or acceptable operating condition. The predetermined torque difference value Td may be selected based on empirical testing, and potentially by other means, such as computer modeling. For example, a plurality of similar or identical machines 100 may be operated under various conditions to determine typical differences between the maximum startup motor torque value Ts and maximum operating motor torque value To for various types and sizes of laundry load, both with and without an entrapment condition. Based on the foregoing, a predetermined torque difference value Td may be selected to represent a likelihood of there being an entrapment condition. For example, if the difference between the maximum startup motor torque value Ts and the maximum operating motor torque value To has a normal distribution within a range of 1-10 units for a normal load, and a normal distribution within a range of 9-20 units for a load having an entrapment, the predetermined torque difference value Td may be selected as 9.5 to ensure a high likelihood of correctly detecting entrapment conditions, and a low likelihood of false entrapment determinations. In the example above, it was determined that a predetermined torque difference value Td of 0.23 Nm is suitable to differentiate between a normal operating condition and an entrapment condition, with approximately 80% likelihood of properly detecting an entrapment and approximately 0% likelihood of incorrectly concluding that there is an entrapment. In this case, the value of Td was selected to ensure a low false positive rate, but other embodiments may be biased in other ways.

It has also been determined that the duration of the entrapment determination process can be relevant to selecting a predetermined torque difference value Td. For example, it has been found that a rotating laundry load, and particularly a dry load, can generate progressively greater maximum operating torque values To as the drum 106 continues to rotate. This is believed to be caused by the articles becoming entangled with each other (which can happen even if none of the articles are trapped between the door and the bellows). It is expected that this "self-entanglement" can vary depending on the type and composition of the laundry load, thus leading to less predictable increases in motor torque as rotation continues. In view of this, the total duration of the entrapment determination process may be considered when selecting a predetermined torque difference value Td, in order to avoid potentially erratic changes in motor torque caused by self-entanglement.

In the foregoing example, it was found that a typical laundry load begins generating higher (and potentially more erratic) maximum operating torque values To after approximately 9 to 10 seconds of rotation at the target speed. In this case, the predetermined torque difference value Td of 0.23 Nm was selected to provide the desired detection rates (e.g., positive and false positive likelihoods) during the first 9 to 10 seconds of rotation at the target speed St. The same predetermined torque difference value Td could also be used for longer durations, but this value could bias the system towards returning false positive detections as the load experiences self-entanglement.

Despite the foregoing example, it will be understood that other embodiments may use other predetermined torque difference values Td, and entrapment determination process durations, as may be desired based on the particular operating characteristics of the machine and the desired detection rates. However, it is preferred to limit the duration of the entrapment determination process to avoid potentially erratic and unpredictable changes in torque that might occur as a result of self-entanglement.

Returning to the algorithm 300 of FIG. 3, if it is determined in step 320 that the difference between the maximum startup motor torque value Ts and the maximum operating motor torque value To (i.e., Ts−To) is less than the predetermined torque difference value Td, it is assumed that an article is entrapped between the door 108 and the bellows 110, and the control unit 114 proceeds to step 322. In step 322, the control unit 114 terminates the entrapment determination process, and terminates operation of the laundry washing cycle.

Termination of the laundry washing cycle in step 322 may comprise any number of functions to address the possible presence of an article entrapped between the door 108 and the bellows 110. For example, the control unit 114 may terminate operation of the drum motor 108 (e.g., cut off power to the drum motor 108 or actively brake or reverse-drive the drum motor 108 or drum 106). The control unit 114 also may activate an alarm at the user interface 116. Such error indicators may include a visual indicator such as a light on a control panel, a message on a remote device, an audible alarm, and so on. Termination of the laundry washing cycle in step 322 also may include an entrapment verification process, such as repeating the acceleration and entrapment determination processes a second or third time.

Alternatively, if it is determined in step 320 that the difference between the maximum startup motor torque value Ts and the maximum operating motor torque value To is not less than the predetermined torque difference value Td, it is assumed that no articles are entrapped between the door 108 and the bellows 110, and the control unit 114 proceeds to step 324. In step 324, the control unit 114 determines whether the timer set in step 312 (e.g., a 10 second timer, 30 second timer, etc.) has elapsed. If the timer has not elapsed, the control unit 114 continues with the entrapment determination process by repeating the monitoring, storing (if applicable) and determining steps. Using this process, the control unit 114 continues the entrapment determination process until an entrapment is detected, or the timer elapses.

Once the control unit 114 determines that the timer has elapsed, the process moves to step 326, in which the selected operation cycle is continued and (if no further errors arise). The operation cycle may include any number of steps, such as one or more filling phases, agitating phases, draining phases, rinsing phases and high-speed spinning phases.

Upon completion of the selected operation cycle in step 326, or termination of the cycle in step 322, the process concludes in step 328.

FIG. 4 illustrates variations on the method described in relation to FIG. 3, with differences as noted in the foregoing description. In particular, FIG. 4 illustrates that process steps such as determining the maximum startup motor torque value Ts may be performed at or after the drum 106 reaches the target rotation speed St, and determining the maximum operating motor torque value To in step 318 and evaluating whether there is an entrapment condition in step 320 may be performed after the timer has elapsed in step 324. In other cases, these variations may be used in other combinations (e.g., only one variation used, but the other processes remaining the same as shown in FIG. 3).

In still other cases, intermediate steps may be introduced into the process. For example, in the process shown in FIG. 3, the control unit 114 may operate the drum 106 at the target speed St for a predetermined amount of time before the entrapment determination process begins in step 312. This may be useful to ensure that the laundry load is at a steady state before beginning to evaluate the maximum operating motor torque value To. Similarly, a process may be introduced to determine and store the maximum starting motor torque value Ts and/or the maximum operating motor torque values To as an average of two or more measured values. Other alternatives and variations will be apparent to persons of ordinary skill in the art in view of the present disclosure.

It will be appreciated that the particular organization of the process steps can also be varied in many ways to provide the same general steps, and to achieve the same results, and the shown examples are not intended to limit the invention.

It will be appreciated from the foregoing that embodiments can provide a method for determining that an article is entrapped between a door 108 and a bellows 110 in the initial starting phase of the machine 100, and preferably before the drum 106 is operated at a high speed. Thus, damage from article entrapments can be avoided or mitigated.

While the embodiments herein are described as being useful to detect an entrapment between the door 108 and bellows 110, it will be appreciated that the methods described herein may also be effective to detect entrapment of an article at other locations within a laundry washing machine. For example, the foregoing methods may be adapted to determine entrapment of an article between a rotating drum and any other non-rotating part (e.g., a ventilation duct opening, a stationary agitator, etc.) that the articles might contact during operation. Furthermore, such methods also may be used to detect entrapped articles in vertical axis laundry washing machines.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this disclosure and the appended claims.

The invention claimed is:

1. A method for detecting entrapment of a wash article using a laundry washing machine comprising a tub configured to hold a quantity of wash liquid, a drum rotatably mounted within the tub and configured to hold a quantity of wash articles, a door movable between an open position and a closed position, a bellows seal configured to seal the door to the tub when the door is in the closed position, a drum motor configured to rotate the drum, and a control unit having a processor and memory storing instructions in a non-transient manner, the method comprising:

receiving, at the processor, an instruction to begin a laundry washing cycle;

operating, by the control unit executing the instructions, the drum motor to accelerate the drum from a stopped state to a target rotation speed;

while accelerating the drum from the stopped state to the target rotation speed, monitoring, by the control unit executing the instructions, a startup motor torque value of the drum motor and identifying a maximum startup motor torque value; and upon accelerating the drum to the target rotation speed, performing by the control unit executing the instructions, an entrapment determination process comprising:

initiating an entrapment determination process timer, operating the drum motor to rotate the drum at the target rotation speed, monitoring an operating motor torque value of the drum motor, identifying a maximum operating motor torque value, determining a difference in value between the maximum startup motor torque value and the maximum operating motor torque value, comparing the difference in value between the maximum startup motor torque value and the maximum operating motor torque value to a predetermined torque difference value, upon determining that the difference in value between the maximum startup motor torque value and the maximum operating motor torque value is less than the predetermined torque difference value, determining that an article is entrapped between the door and the bellows seal, terminating operation of the entrapment determination process and terminating operation of the laundry washing cycle, and upon determining that the difference in value between the maximum startup motor torque value and the maximum operating motor torque value is greater than the predetermined torque difference value, and upon the entrapment determination process timer reaching a predetermined time value, determining that no article is entrapped between the door and the bellows seal, terminating operation of the entrapment determination process and continuing operation of the laundry washing cycle.

2. The method of claim 1, wherein the target rotation speed comprises about 55 to about 65 rotations per minute.

3. The method of claim 1, wherein the target rotation speed comprises about 60 rotations per minute.

4. The method of claim 1, wherein the target rotation speed is less than a satellization speed.

5. The method of claim 1, wherein the entrapment determination process timer has a duration of 10 seconds or less.

6. The method of claim 1, wherein terminating operation of the laundry washing cycle comprises terminating operation of the drum motor and activating an alarm at a user interface.

7. The method of claim 1, wherein continuing operation of the laundry washing cycle comprises operating the drum motor, one or more valves, and one or more pumps to perform a sequence of laundry cleaning phases.

8. The method of claim 1, wherein comparing the difference in value between the maximum startup motor torque value and the maximum operating motor torque value to the predetermined torque difference value is performed at one or more intervals prior to the entrapment determination process timer reaching the predetermined time value.

9. The method of claim 1, wherein comparing the difference in value between the maximum startup motor torque value and the maximum operating motor torque value to the predetermined torque difference value is performed upon the entrapment determination process timer reaching the predetermined time value.

10. The method of claim 1, wherein the drum is rotatably mounted to rotate about a horizontal axis.

11. A laundry washing machine comprising:

a tub configured to hold a quantity of wash liquid;

a drum rotatably mounted within the tub and configured to hold a quantity of wash articles;

a door movable between an open position and a closed position;

a bellows seal configured to seal the door to the tub when the door is in the closed position;

a drum motor configured to rotate the drum; and a control unit having a processor and a memory storing, in a non-transient manner, instructions configured to be executed by the processor, to thereby cause the control unit to:

receive an instruction to begin a laundry washing cycle;

operate the drum motor to accelerate the drum from a stopped state to a target rotation speed;

while accelerating the drum from the stopped state to the target rotation speed, monitor a startup motor torque value of the drum motor and identifying a maximum startup motor torque value; and upon accelerating the drum to the target rotation speed, initiate an entrapment determination process comprising:

initiating an entrapment determination process timer, operating the drum motor to rotate the drum at the target rotation speed, monitoring an operating motor torque value of the drum motor, identifying a maximum operating motor torque value, determining a difference in value between the maximum startup motor torque value and the maximum operating motor torque value, comparing the difference in value between the maximum startup motor torque value and the maximum operating motor torque value to a predetermined torque difference value, upon determining that the difference in value between the maximum startup motor torque value and the maximum operating motor torque value is less than the predetermined torque difference value, determining that an article is entrapped between the door and the bellows seal, terminating operation of the entrapment determination process and terminating operation of the laundry washing cycle, and upon determining that the difference in value between the maximum startup motor torque value and the maximum operating motor torque value is greater than the predetermined torque difference value, and upon the entrapment determination process timer reaching a predetermined time value, determining that no article is entrapped between the door and the bellows seal, terminating operation of the entrapment determination process and continuing operation of the laundry washing cycle.

12. The laundry washing machine of claim 11, wherein the target rotation speed comprises about 55 to about 65 rotations per minute.

13. The laundry washing machine of claim 11, wherein the target rotation speed comprises about 60 rotations per minute.

14. The laundry washing machine of claim 11, wherein the target rotation speed is less than a satellization speed.

15. The laundry washing machine of claim 11, wherein the entrapment determination process timer has a duration of 10 seconds or less.

16. The laundry washing machine of claim 11, wherein terminating operation of the laundry washing cycle comprises terminating operation of the drum motor and activating an alarm at a user interface.

17. The laundry washing machine of claim 11, wherein continuing operation of the laundry washing cycle comprises operating the drum motor, one or more valves, and one or more pumps to perform a sequence of laundry cleaning phases.

18. The laundry washing machine of claim 11, wherein comparing the difference in value between the maximum startup motor torque value and the maximum operating motor torque value to the predetermined torque difference value is performed at one or more intervals prior to the entrapment determination process timer reaching the predetermined time value.

19. The laundry washing machine of claim 11, wherein comparing the difference in value between the maximum startup motor torque value and the maximum operating motor torque value to the predetermined torque difference value is performed upon the entrapment determination process timer reaching the predetermined time value.

20. The laundry washing machine of claim 11, wherein the a drum is rotatably mounted to rotate about a horizontal axis.

* * * * *